US006315254B1

(12) United States Patent
Maloney

(10) Patent No.: US 6,315,254 B1
(45) Date of Patent: Nov. 13, 2001

(54) OBJECT SUPPORT MEANS FOR WALLS AND METHOD OF USE

(76) Inventor: Kevin D. Maloney, 915 W. Balboa Blvd., Unit C, Newport Beach, CA (US) 92661

( * ) Notice: Subject to any disclaimer, the term of this patent is extended or adjusted under 35 U.S.C. 154(b) by 0 days.

(21) Appl. No.: 09/459,259

(22) Filed: Dec. 10, 1999

(51) Int. Cl.[7] ..... F16B 47/00
(52) U.S. Cl. ..... 248/205.3; 248/217.3
(58) Field of Search ..... 248/205.3, 205.4, 248/216.1, 216.4, 217.3

(56) References Cited

U.S. PATENT DOCUMENTS

| | | | | |
|---|---|---|---|---|
| 104,164 | * | 6/1870 | Studd | 248/216.1 |
| 297,173 | * | 4/1884 | Selinger | 248/217.3 |
| 856,302 | * | 6/1907 | Rosenberg et al. | 248/217.3 |
| 1,099,137 | | 6/1914 | Williams . | |
| 2,122,999 | * | 7/1938 | Burke | 248/467 |
| 2,723,815 | * | 11/1955 | Browning | 248/216.4 X |
| 3,300,173 | | 1/1967 | Kennedy, Jr. . | |
| 3,715,781 | | 2/1973 | Salvatori . | |
| 4,422,608 | | 12/1983 | Hogg . | |
| 4,493,577 | | 1/1985 | Cosenza . | |
| 4,524,506 | * | 6/1985 | Wilke | 248/251 X |
| 4,724,638 | | 2/1988 | Bezborodko . | |
| 5,112,177 | | 5/1992 | Chamings . | |
| 5,269,485 | | 12/1993 | Dwinell et al. | 248/216.4 |
| 5,370,487 | | 12/1994 | Kracke . | |

FOREIGN PATENT DOCUMENTS

670366-A * 6/1989 (CH) ..... 248/216.1

* cited by examiner

*Primary Examiner*—Ramon O. Ramirez
(74) *Attorney, Agent, or Firm*—Knobbe, Martens, Olson & Bear, LLP

(57) ABSTRACT

A system for independently supporting one or more objects from a wall comprising a panel member secured to at least one rearwardly projecting pin wherein the panel member has a layer of adhesive material on at least one exposed surface thereof and wherein the pin has a longitudinal dimension of at least ½before words to ¾before words inches to permit effective engagement with a cubicle partition wall. A method of supporting more than one object from a support means used to engage a cubicle partition wall comprising the steps of engaging a support means that has a panel member and a pin with the wall so that the pin penetrates a structural wall portion of the cubicle partition wall for secure engagement therewith, wherein the panel member has a layer of adhesive material on an exposed surface thereof, whereby the pin may be used to pierce a first object, such as a document, to bind the first object between the panel member and the wall when the support means is inserted into the wall and whereby the adhesive layer may be used to detachably support a second object with removing the support means from the wall.

8 Claims, 4 Drawing Sheets

OBJECT SUPPORT MEANS FOR WALLS AND METHOD OF USE

FIELD OF THE INVENTION

The present invention relates generally to a system for fastening objects to a wall and, in particular, to a support means including a panel member and a pin for supporting multiple documents at one time.

BACKGROUND OF THE INVENTION

It is an artifact of the office environment that documents and other objects are typically fastened to the wall of one's work space. For some, documents or notes are fastened to the wall as a reminder of important tasks to be done. For others, a simple calendar is hung. For others still, decorative paraphernalia, such as pictures or cards, are fastened to the wall for visual aesthetics or as a statement of one's point of view. Numerous other reasons exist for why people generally fasten things upon the wall.

Whatever the type of object desired to be hung, means must be employed to hang the object in a sufficiently sturdy fashion to prevent the object from falling down due to its own weight. In some cases, it is not required that the object be readily retrieved, permitting semi-permanent application. In other cases, quick retrieval is desired. In the former case, when it is desired to remove the object, it is of little concern that one need remove the hanging means as well. In the latter case, it is of greater concern. It is preferable to employ a support means that itself need not be removed from the wall every time it is desired to remove the object, such as a note or other document that has a short period of relevance to the user.

One support means is, of course, adhesive tape. While it is effective, it cannot be removed easily from the wall and/or the document without some risk of scarring either or both. Moreover, tape does not hold much weight. Staples may be used, but they are not desirable because of the relative difficulty of applying staples to or removing them from a wall. Another example is a thumb tack or push pin. Because thumb tacks may be used on almost any surface, they are very versatile. Tacks, however, are not very effective on cubicle partition walls, particularly with objects that are relatively heavy, such as calendars. Typically, cubicle walls are constructed with a layer of low density sound absorbing material with a fabric covering. The low density material does not support much weight. Thus, multiple tacks must be used to support such an object. For the same reason, staples are not very effective, either. Moreover, the use of a fabric covering prevents the use of tape. While clips may be used, they are not nearly as versatile in their placement on such a partition wall. Thus, a person whose work space is defined by one or more cubicle partition walls is handicapped from posting many objects, if any, on the wall.

Even with walls capable of supporting objects, particularly where wall space is limited, it is often desired to independently support more than one object (e. g., documents) via the same fastener; for example, a larger document behind a smaller document, permitting both to be viewed simultaneously. While a single thumb tack might suffice, one cannot remove the top document without removing both documents. A stapler suffers from the same problem. Tape cannot be used because it cannot hold up more than one document at a time. While a clip may be used, again it requires the release of both documents in order to retrieve one of them.

There have been some attempts to embellish tacks to permit supporting of documents without the need to penetrate the document with the pin of the tack. For example, U. S. Pat. No. 1,099,137 to Williams discloses a thumb tack with an integral clip formed on the head of the tack. The purpose disclosed is to support a document within the clip. No mention is made of supporting more than one document at a time. Another example is U. S. Pat. No. 5,370,487 to Kracke, which discloses a conventional thumb tack that employs a head that forms a clip for supporting papers in the same manner of the '137 patent to Williams. U.S. Pat. No. 5,112,177 to Chamings discloses flexible fasteners that employ two wall penetrating pins that are normally not parallel but may be made parallel for insertion into the wall by squeezing two tabs on the head. It is disclosed that one of the tabs may be used for hanging objects therefrom. None of the above three references discloses an adhesive coated head for quick release of documents from the support. While adhesive coated paper notes, such as a Post-it® note, are advantageous, most documents do not come ready made with an easily removable adhesive.

U.S. Pat. No. 5,269,485 to Dwinell et al. discloses a fastener with an adhesive means on the head of the fastener. The Dwinell fastener is intended to solve the problem of hanging objects on cloth covered cubicle partitions, as explained therein. The disadvantage of the Dwinell et al. device, however, is that it cannot hold much weight because it is not secured to the structural wall portion of the cubicle wall. The entire weight of the object supported is carried by the fabric covering the cubicle. That is an inefficient support system. Moreover, because the fastener does not employ a rearwardly directed pin, the pin does not function as a means for independently supporting objects such as a document. That function is served only by the adhesive covered head.

It would be advantageous, therefore, to provide a support means that includes an adhesive surface so that one or more documents may be held against the wall by the pressure of a pin head while the adhesive could hold a separate document, for independent release of the documents. It would also be advantageous to have a multidocument support system that is configured to permit effective use with cubicle partition walls, particularly the type that employ thick padded walls.

SUMMARY OF THE INVENTION

The present invention comprises a support means having a rearwardly projecting pin of sufficient strength and length to project well into a cubicle wall padding to securely hold the support means in place. The pin may be used to secure a first object to the cubicle wall. The support means further comprises a panel member that includes on one face thereof means for releasably adhering a second object thereto, such that the second object may be released without having to remove the support means from the cubicle wall or without disturbing the first object. In an alternative embodiment, a plurality of pins are used to permit increased size of the panel member and/or to more securely engage a wall surface. The present invention also comprises a method of supporting more than one object from a support means used to engage a cubicle partition wall, wherein the support means includes, in at least one embodiment, the features described herein.

BRIEF DESCRIPTION OF THE DRAWINGS

These and other features and advantages of the invention will now be described with reference to the drawings, which are intended to illustrate and not to limit the invention.

DETAILED DESCRIPTION OF THE PREFERRED EMBODIMENTS

Turning now to the drawings provided herein, a more detailed description of the embodiments of the present invention is provided below. It should be noted, however, that while some embodiments have all of the advantages identified herein, other embodiments may only realize some but not all of the advantages.

Figure 1:
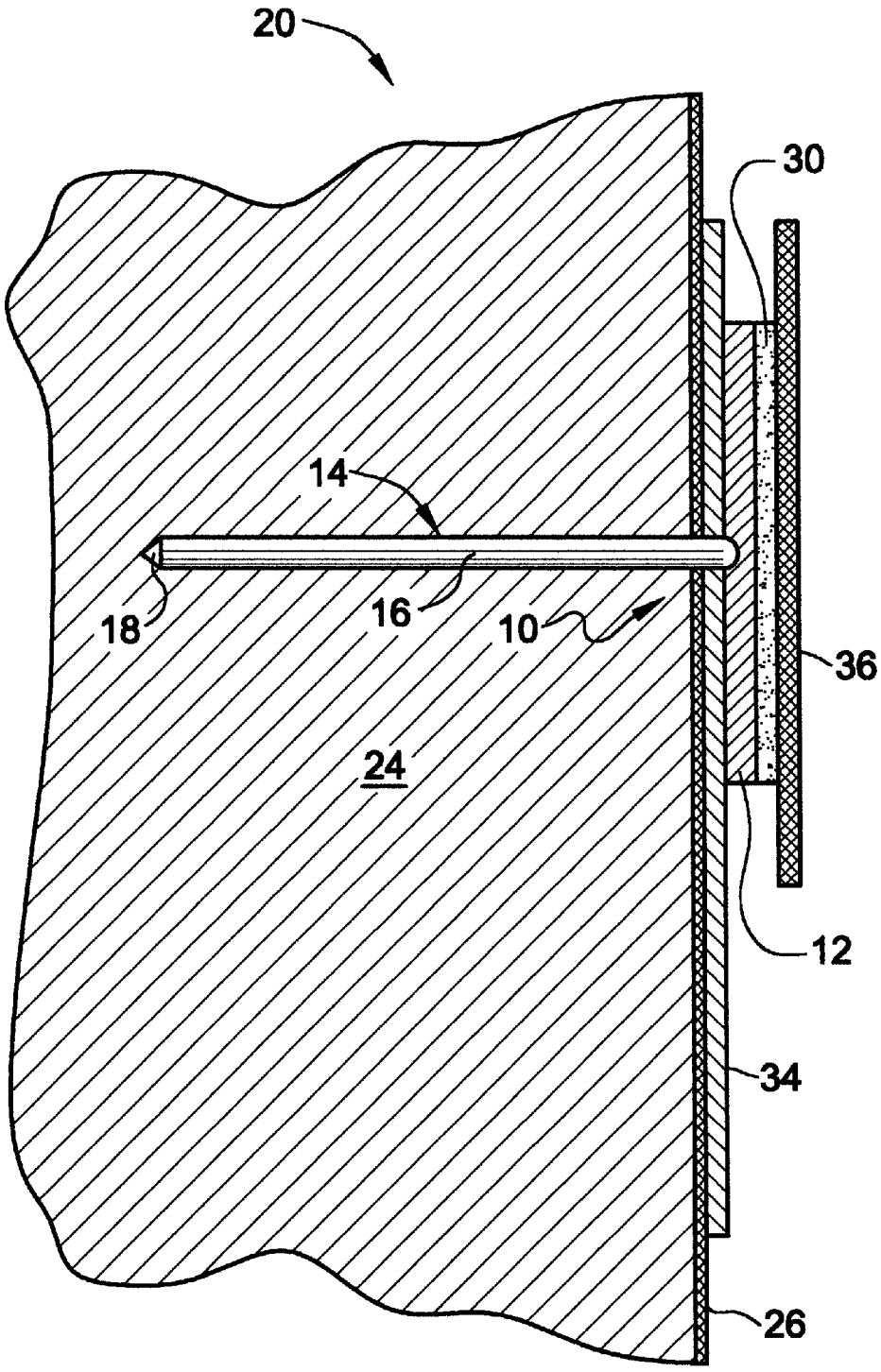
FIG. 1 is a cross sectional side view of one embodiment of the present invention support means shown inserted into a cubicle partition wall.
Figure 2:
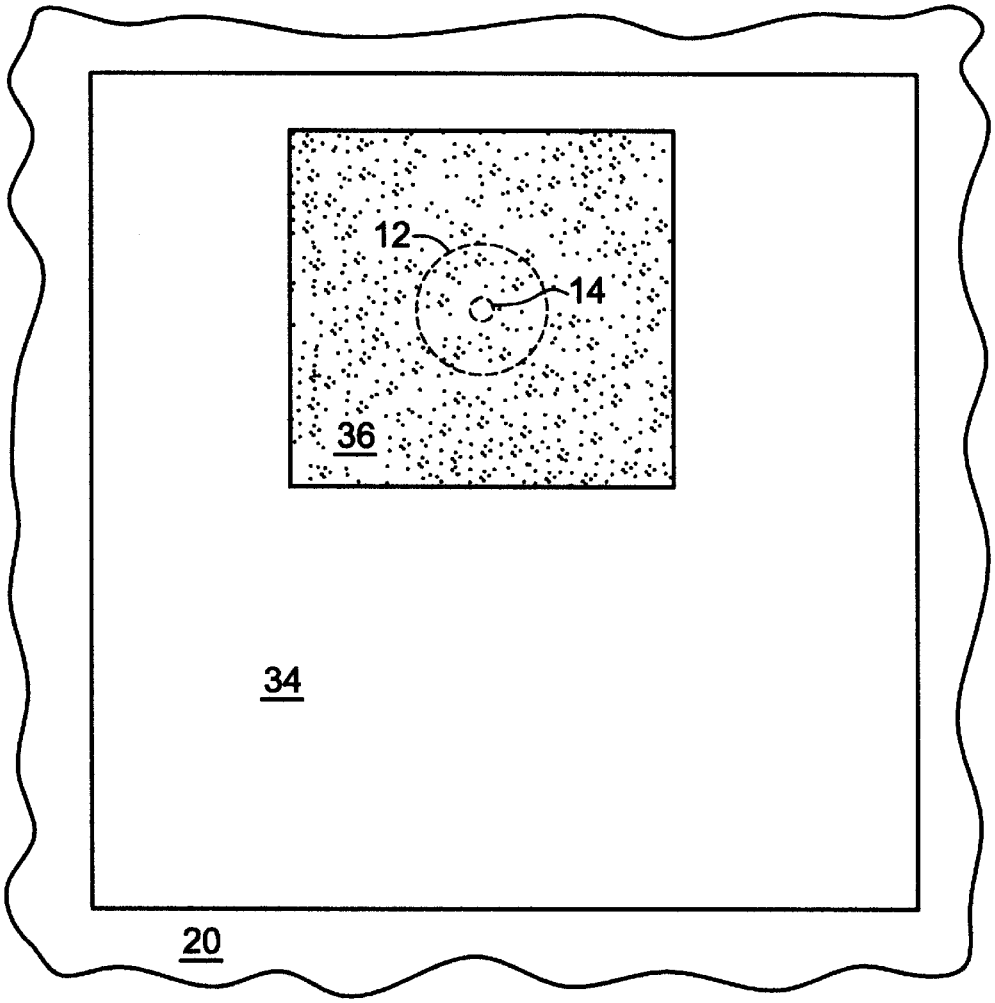
FIG. 2 is a front view of the support means of FIG. 1 showing two objects being supported thereon.

Referring to FIGS. 1 and 2, the present invention comprises a support means 10 for hanging one or more objects from a wall, such as a conventional permanent wall or a cubicle partition wall that is made of low density noise absorbing material. In one embodiment, the support means 10 comprises a generally planar panel member 12 that is secured to a pin 14 that projects rearwardly at a generally perpendicular orientation to the panel member 12.

The pin 14 comprises a shaft portion 16 with a sharp distal end 18. FIG. 1 shows the support means 10 secured to a cubicle wall 20 that includes a relatively thick layer of low density material 24 and a fabric covering 26. The pin shaft portion 16 is preferably sufficiently long and of sufficient strength to project into the cubicle partition wall 20 to securely engage the wall material 24. Thus, it is contemplated that the pin 14 of the present invention be at least ½ to ¾ inches in length.

The support panel 12 preferably includes a layer of adhesive material 30 that permits repeated attachment and detachment of objects, such as a document, without significantly reducing its adhesive quality. When sold, the adhesive material 30 would preferably be covered with a protective sheet (not shown) to protect the adhesive material from inadvertent exposure to objects or conditions that would reduce its adhesive quality before the support means 10 were put to use.

It is contemplated that the panel member may have more than one face upon which an adhesive layer may be provided for supporting multiple objects, one or more from each face. It is further contemplated that the panel member further comprise a means in addition to the adhesive layer, such as a clip, to support an additional object. The location of the additional support means would be user dependent and a function of the availability of space and the size of the panel member.

With the present invention, as shown in FIG. 1, the support means 10 may be secured to a cubicle partition and yet hold more than one object. By way of example, the support means 10 is shown securing a first document 34 against the cubicle wall via the pin 14. The support means 10 also supports a second document 36 via the adhesive material 30. Given that objects desired to be supported come in all shapes and sizes, it is contemplated that the present invention would include support panel 12 of all sizes and shapes; e. g., circular, rectangular, etc., particular if it is desired to have a panel member with additional faces and/or additional support means. One may attach and detach the second document 36 without removing the support means 12 from the cubicle wall 20.

Figure 3:
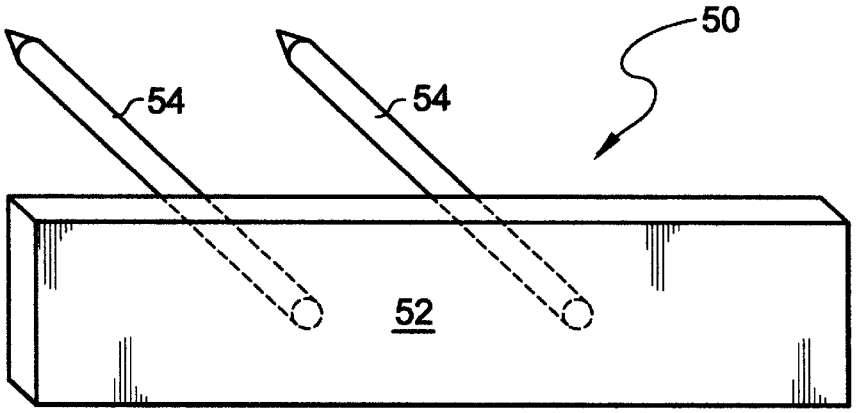
FIG. 3 is a perspective view of a second embodiment of the present invention.

Referring to FIG. 3, an alternative embodiment of the present invention comprises a support means 50 having features generally similar to the support means 10 of FIG. 1, including a planar member 52, except that a plurality of pins 54 are employed, rather than one pin. In the specific embodiment shown, two pins 54 are used, although any number of pins may be employed depending upon the size of the panel member 52 or the weight of the objects desired to be supported thereby. The panel member 52 also includes a layer of adhesive material, similar to the layer of FIG. 1. It is contemplated that the adhesive material would permit ready detachability of objects, such as documents, in the manner described above.

Figure 4:
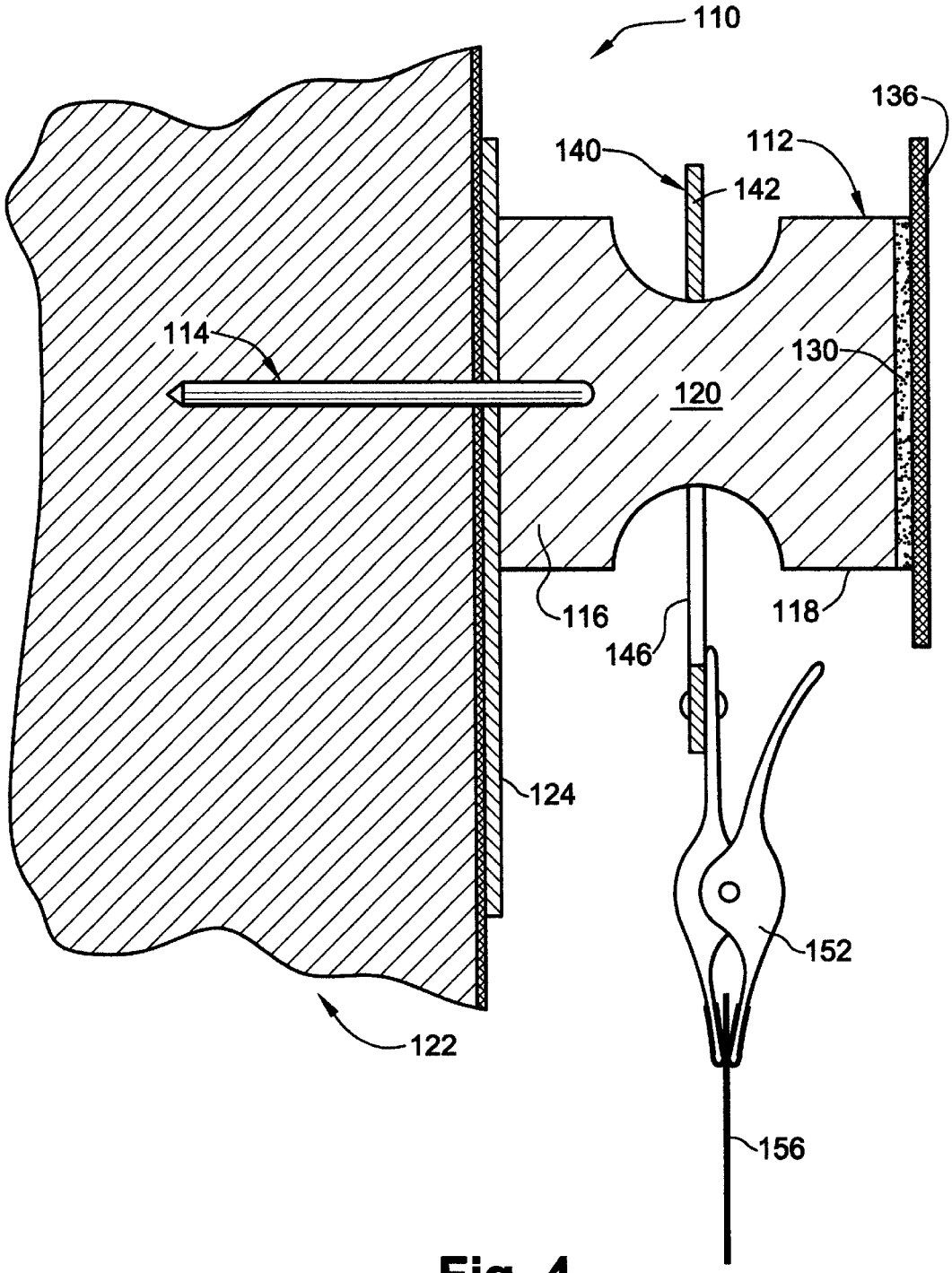
FIG. 4 is a cross-sectional side view of a third embodiment of the present invention shown inserted into a cubicle partition wall.
Figure 5:
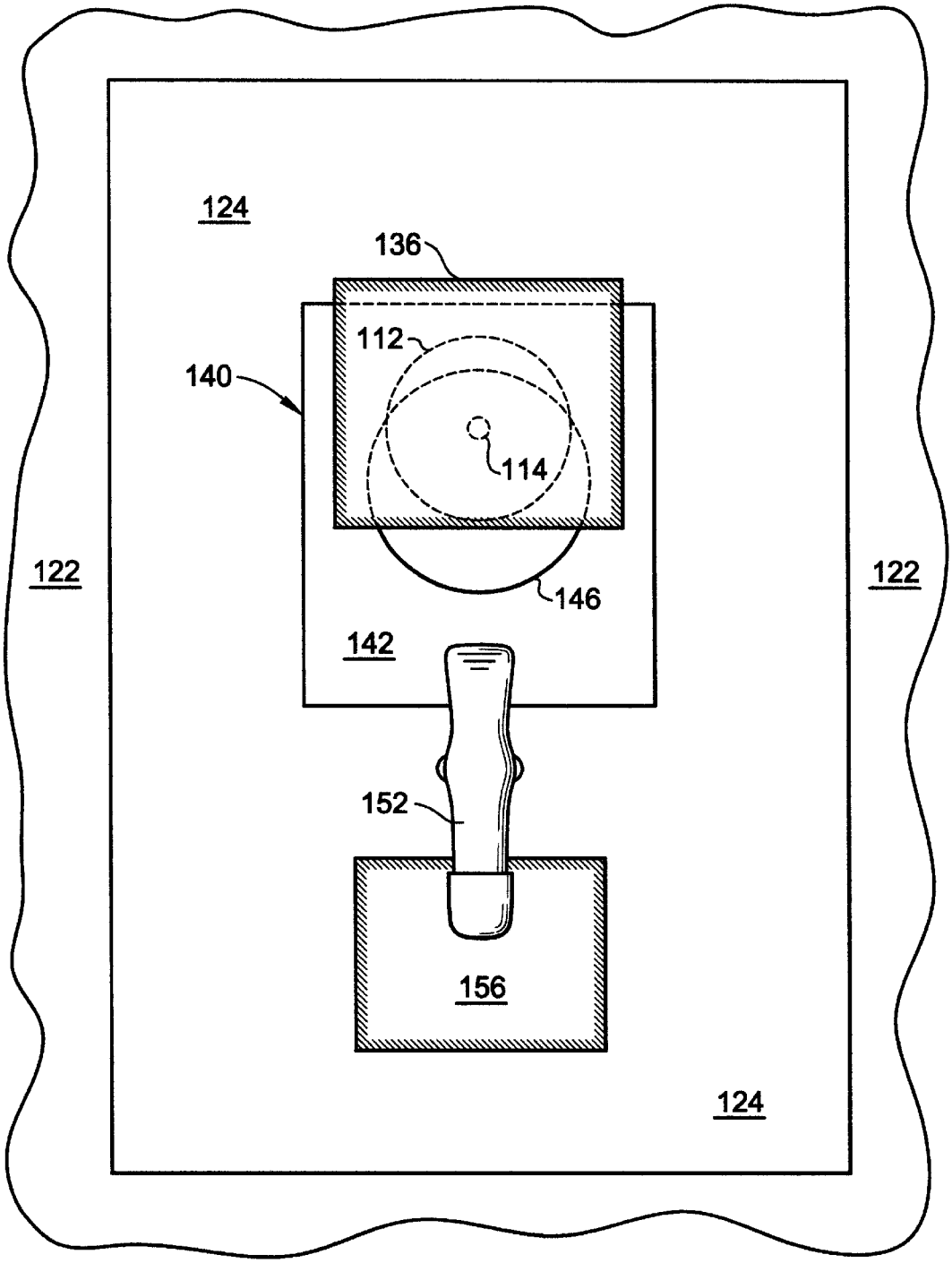
FIG. 5 is a front view of the support means of FIG. 4 showing three objects being supported thereon.

By employing a plurality of pins, a larger panel member 52 may be used, permitting larger objects or multiple objects to be supported by the panel member. Moreover, depending upon the spacing of the pins, each of the pins may be used to independently support different objects, such as documents. The panel member 52 shown in FIG. 2 is of a generally rectangular shape, although any shape and size is contemplated. The larger the panel member, the more pins may be necessary to effectively support the panel member and objects supported thereon. The pins 54 of FIG. 2 have features similar to those of FIG. 1 to permit effective engagement with a wall or a structural wall portion of a cubicle partition Reference is now made to FIGS. 4 and 5. In another embodiment, exemplary of variations contemplated by the present invention, the support means 110 comprises a hard material panel member 112 secured to a pin 114 that projects rearwardly at a generally perpendicular orientation to the head member 112. The pin 114 is contemplated to have similar features to the pin 14 of FIG. 1 for the reasons described above. The panel member 112 is not in planar configuration as in the first embodiment but, rather, has a proximate end 116 and a distal end 118 separated by an intermediary section 120. When the support means 110 is inserted into a wall, such as a cubicle partition wall 122, it may be used to support an object, such as a document 124, via the pin 114, as with the first embodiment of FIG. 1.

The distal end 118 also includes a layer of adhesive material 130 on the exposed surface of the distal end for detachably securing objects to the head member 112. As shown in FIG. 3, the adhesive layer could be used to support an object 136 thereon which may be detached or attached relatively easily without having to disturb the support means 110, much like with the first embodiment of FIG. 1. It is also contemplated that the panel member further comprise a means in addition to the adhesive layer, such as a clip, to support an additional object. The location of the additional support means would be user dependent and a function of the availability of space and the size of the panel member.

The intermediary section 120 preferably has a cross-sectional dimension that is smaller than the cross-sectional dimension of the proximate and distal ends to permit an object to be suspended from the intermediary section 120 without slipping off of the distal end 118. As shown in FIG. 3, the intermediary section 120 is generally hemispherical in shape, although other shapes are contemplated, so as to support a third object (not shown) that has an opening or a hook on it to engage the intermediary section. Alternatively, the intermediate section 120 could support a hanging means 140 thereon. In one embodiment, the hanging means 140 comprises a planar member 142 with an opening 146 to permit supporting the hanging means 140 on the intermediary section 120. The opening 146 is large enough to fit over the distal end 118 to rest in the intermediary section. If desired, a hook may be used instead of an opening so that the planar member 142 can be suspended without need of an opening in the member. The hanging means 140 may further comprise a clip 152 for supporting yet another object 156 therefrom. As with the first embodiment, the support means 110 of FIG. 3 may be used to securely engage the structural wall portion of a cubicle office partition so as to permit effective support of one or more objects. With this latter embodiment, however, as many as three objects may be suspended from the support means 110 in a manner in which at least two may be removed without the need to detach and reattach the support means 110 from the wall.

If desired, the hanging means 140 may comprise a planar member 142 with or without an opening so as to be fastened directly to the cubicle wall 122 via pin 114. In that circumstance, the pin 114 could be used to penetrate each of (i) the planar member 142 of the hanging means 140, (ii) the document 124, and (iii) the cubicle wall 122 so that the planar member 142 and document 124 are sandwiched between the proximate end 116 of the panel member 112 and the cubicle wall 122. Objects could be hung from the clip 152 without the need to remove the support means 110 from the wall.

It is contemplated that the panel member have more than one face with an adhesive layer on it whereby each face may separately support an object, such as a document or picture, etc. Thus, the three-dimensional shape of the panel member may be varied depending upon the desired use. It is also contemplated that the panel member further comprise an integral means in addition to the adhesive layer, such as a clip, to support an additional object. The location of the additional support means would be user dependent and a function of the availability of space and the size of the panel member.

The present invention also comprises a method of supporting more than one object from a support means used to engage a cubicle partition wall. The method comprises the steps of engaging a support means that has a panel member and a pin into the wall so that the pin penetrates the cubicle partition wall sufficiently deep for secure engagement therewith, wherein the panel member has a layer of adhesive material on an exposed surface thereof, whereby the pin may be used to pierce a first object, such as a document, to bind the first object between the panel member and the wall when the support means is inserted into the wall and whereby the adhesive layer may be used to detachably support a second object without removing the support means from the wall. The method may further comprise the step of providing a support means having the features described above, including a plurality of pins or a head member having proximate and distal ends.

While the above description has explained the inventive features of the invention as applied to various embodiments, it will be understood that the variations in the form and details of the apparatus or method may be made by those of ordinary skill in the art without departing from the spirit of the invention. It should be appreciated that the present support system could be used on many surface or wall types, including but not limited to corkboard or medium-to-high density walls, including those found in homes and garages. The scope of the invention is indicated by the appended claims herein, however, not by the foregoing description.

What is claimed is:

1. A system for supporting one or more objects from a wall, said system comprising a panel member secured to at least one rearwardly projecting pin, said panel member having a plurality of surfaces, a first surface being configured to face the wall after said support system is inserted into said wall, and a second surface exposed to the user after said support system is inserted into said wall, said second surface being positioned opposite of said first surface and having a layer of adhesive material thereon, said pin having a longitudinal dimension of at least ½ to ¾ inches to permit effective engagement with a cubicle partition wall, a distal end of said pin being sufficiently strong and tapered to permit insertion into a relatively low density material and withstand the weight of objects desired to be hung from the wall.

2. The system of claim 1 further comprising at least one more pin projecting rearwardly from the panel member.

3. The system of claim 1 wherein the panel member has a proximate end and a distal end, said distal end having the layer of adhesive material thereon.

4. The system of claim 3 wherein the panel member further comprises an intermediary section for suspending yet another object thereon.

5. The system of claim 1 further comprising a hanging means for supporting yet additional objects therefrom.

6. A method of supporting more than one object from a support means used to engage a cubicle partition wall, said method comprising the steps of engaging a support means that has a panel member and a pin with the wall so that the pin penetrates the cubicle partition wall sufficiently deep for secure engagement therewith, wherein the panel member has a layer of adhesive material on an exposed surface thereof, whereby the pin may be used to pierce a first object, such as a document, to bind the first object between the panel member and the wall when the support means is inserted into the wall and whereby the adhesive layer may be used to detachably support a second object without removing the support means from the wall.

7. The method of claim 6 further comprising the step of providing the support means for use with engagement with the cubicle partition wall.

8. The method of claim 6 wherein the support means includes a plurality of pins.

* * * * *